US009470076B2

(12) United States Patent
Edwards et al.

(10) Patent No.: US 9,470,076 B2
(45) Date of Patent: Oct. 18, 2016

(54) SYSTEMS AND METHODS FOR PRODUCTION OF GAS WELLS

(71) Applicants: Paul A. Edwards, Bayfield, CO (US); Timothy Idstein, Houston, TX (US)

(72) Inventors: Paul A. Edwards, Bayfield, CO (US); Timothy Idstein, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 19 days.

(21) Appl. No.: 14/339,334

(22) Filed: Jul. 23, 2014

(65) Prior Publication Data

US 2015/0027693 A1 Jan. 29, 2015

Related U.S. Application Data

(60) Provisional application No. 61/859,501, filed on Jul. 29, 2013.

(51) Int. Cl.
*E21B 43/14* (2006.01)
*E21B 43/12* (2006.01)

(52) U.S. Cl.
CPC ..... *E21B 43/14* (2013.01); *E21B 43/121* (2013.01)

(58) Field of Classification Search
CPC .... E21B 43/12; E21B 43/121; E21B 43/122; E21B 43/128; E21B 43/14; E21B 43/00
See application file for complete search history.

(56) References Cited

U.S. PATENT DOCUMENTS

| | | | |
|---|---|---|---|
| 3,263,753 | A | 8/1966 | Corley, Jr. |
| 3,381,753 | A | 5/1968 | Fredd |
| 3,448,803 | A | 6/1969 | Sizer |
| 3,666,012 | A | 5/1972 | Sizer et al. |
| 4,226,284 | A | 10/1980 | Evans |
| 5,904,209 | A | 5/1999 | Kenworthy et al. |
| 5,950,651 | A | 9/1999 | Kenworthy et al. |
| 6,568,477 | B1 | 5/2003 | Dveyrin |
| 8,261,838 | B2 | 9/2012 | Bullen |
| 8,297,363 | B2 | 10/2012 | Kenworthy et al. |
| 2002/0007953 | A1 | 1/2002 | Liknes |
| 2004/0200615 | A1 | 10/2004 | Wilde |
| 2009/0321083 | A1 | 12/2009 | Schinagl |

(Continued)

FOREIGN PATENT DOCUMENTS

| | | |
|---|---|---|
| WO | 2012/058288 A2 | 5/2012 |
| WO | 2013010244 | 1/2013 |

OTHER PUBLICATIONS

PCT Search Report Dated Jan. 5, 2015.

*Primary Examiner* — Zakiya W Bates
(74) *Attorney, Agent, or Firm* — John L. Wood

(57) ABSTRACT

A method for producing gas from a well including a wellbore extending from a surface into a subterranean formation, wherein the well also produces liquid, the method including: (a) producing gas from a production zone in the subterranean formation through an annulus extending within the wellbore at a first velocity that is greater than a critical velocity, and (b) pumping liquid through a liquid tubing string after (a) to reduce a level of the liquid within the wellbore. The method also includes: (c) shutting in the annulus after (a) after the first velocity decreases below the critical velocity, wherein the annulus has a first cross-sectional area and the first production string has a second cross-sectional area that is less than the first cross-sectional area, and (d) producing gas from the production zone through the first production tubing string after (c) at a second velocity being greater than the critical velocity.

21 Claims, 7 Drawing Sheets

(56) References Cited

U.S. PATENT DOCUMENTS

| | | | | |
|---|---|---|---|---|
| 2010/0051267 | A1 | 3/2010 | Lowe | |
| 2011/0004352 | A1 | 1/2011 | Wilde et al. | |
| 2011/0073319 | A1 | 3/2011 | Wilson | |
| 2013/0043031 | A1* | 2/2013 | Tunget | E21B 21/12 166/313 |
| 2013/0199794 | A1* | 8/2013 | Lane | E21B 34/00 166/372 |
| 2015/0027690 | A1 | 1/2015 | Aman et al. | |

* cited by examiner

SYSTEMS AND METHODS FOR PRODUCTION OF GAS WELLS

CROSS-REFERENCE TO RELATED APPLICATIONS

This application claims priority under 35 USC §119(e)(1) of prior U.S. Provisional Patent Application Ser. No. 61/859,501, filed Jul. 29, 2013, which is hereby incorporated by reference in its entirety.

STATEMENT REGARDING FEDERALLY SPONSORED RESEARCH OR DEVELOPMENT

Not applicable.

BACKGROUND

The invention relates generally to oil and gas wells. More particularly, the invention relates to systems and methods for producing hydrocarbon gas from a formation that is also producing liquids.

Geological formations that yield gas also produce liquids that accumulate at the bottom of the wellbore. In general, the liquids comprise hydrocarbon condensate (e.g., relatively light gravity oil) and interstitial water from the reservoir. The liquids accumulate in the wellbore in two ways—as single phase liquids that migrate into the wellbore from the surrounding reservoir, and as condensing liquids that fall back into the wellbore during production of the gas. The condensing liquids actually enter the wellbore as vapors; however, as they travel up the wellbore, their temperatures drop below the respective dew points and they change phase into liquid condensate.

In some hydrocarbon producing wells that produce both gas and liquid, the formation gas pressure and volumetric flow rate are sufficient to lift the liquids to the surface. In such wells, liquids do not accumulate but are instead moved up and out of the wellbore by the velocity of the gas stream. However, in wells where the gas does not provide sufficient transport energy to lift liquids out of the well (i.e., the formation gas pressure and volumetric flow rate are not sufficient to lift liquids to the surface), the liquids accumulate in the wellbore.

For example, referring now to FIG. 1, a conventional system 10 for producing hydrocarbons from a well 20 is shown. Well 20 includes a wellbore 26 that extends through a subterranean formation 30 along a longitudinal axis 17. System 10 generally includes a wellhead 13 at the upper end of the wellbore 26, a production tree 12 mounted to wellhead 13, a primary conductor 21 extending from wellhead 13 into wellbore 26, a casing string ("casing") 22 coupled to wellhead 13 and extending concentrically through primary conductor 21 into wellbore 26, and a liquid tubing string 50 coupled to wellhead 13 and extending through casing 22 into wellbore 26 to a depth $H_{50}$. An annulus 27 is formed between string 50 and casing 22. A fluid flow mechanism or pump 60 is disposed within string 50 and is configured to induce a flow of fluids from wellbore 26 to surface 15 through tubing string 50. In this embodiment pump 60 is a pumpjack that comprises a plunger disposed within string 50 that is actuated (e.g., reciprocated) within string 50 by a surface mechanism 62 to draw fluids to the surface 15 through string 50. Tree 12 includes a plurality of valves 11 configured to regulate and control the flow of fluids into and out of wellbore 26 during production operations.

During operation, formation fluids (e.g., gas, oil, condensate, water, etc.) flow into the wellbore 26 from a production zone 32 of formation 30 via perforations 24 in casing 22. Thereafter, the produced fluids flow to the surface 15 through the annulus 27. In most cases, the production zone 32 initially produces gas to the surface 15 through annulus 27 with sufficient pressure and volumetric flow rate to lift liquids that enter wellbore 26 from zone 32 through perforations 24. However, over time, the pressure and volumetric flow rate of the gas decreases until it is no longer capable of lifting the liquids that enter wellbore 26 to the surface 15. At some point, the gas velocities drop below the "critical velocity", which is minimum velocity required to carry a droplet of water to the surface 15. As time progresses, droplets of liquid accumulate in the bottom of the wellbore, thereby forming a column 70 of liquid having a height $H_{70}$. This column 70 of accumulated liquids imposes a back-pressure on the formation 30 that begins to restrict the flow of gas into wellbore 26, thereby detrimentally affecting the production capacity of the well 20. Consequently, once the liquids are no longer lifted to the surface with the produced gas, the well 20 will eventually become "loaded" as the liquid hydrostatic head pressure begins to overpower the lifting action of the gas flow, at which point the well is "killed" or "shuts itself in."

To maintain and continue production from well 20, operators typically, among other things, engage in artificial lift techniques or processes to remove the accumulated liquids from the wellbore to restore the flow of gas from the formation into the wellbore and ultimately to the surface. For example, in the embodiment shown in FIG. 1, pump 60 is engaged to draw out liquids from wellbore 26 in order to lower or maintain the height $H_{70}$ of column 70 to ensure adequate production from well 20 through annulus 27. The process for removing such accumulated liquids from a wellbore is commonly referred to as "deliquification" or in some cases "dewatering".

BRIEF SUMMARY OF THE DISCLOSURE

These and other needs in the art are addressed in one embodiment by a method for producing gas from a well including a wellbore extending from a surface into a subterranean formation, wherein the well also produces a liquid. In an embodiment, the method comprises (a) producing gas from a production zone in the subterranean formation through an annulus extending within the wellbore at a first velocity that is greater than a critical velocity. In addition, the method comprises (b) pumping liquid through a liquid tubing string after (a) to reduce a level of the liquid within the wellbore. Further, the method comprises (c) shutting in the annulus after (a) after the first velocity decreases below the critical velocity, wherein the annulus has a first cross-sectional area and the first production string has a second cross-sectional area that is less than the first cross-sectional area. Still further, the method comprises (d) producing gas from the production zone through the first production tubing string after (c) at a second velocity that is greater than the critical velocity.

These and other needs in the art are addressed in another embodiment by a method for producing gas from a well including a wellbore extending from a surface into a subterranean formation, wherein the well also produces a liquid. In an embodiment, the method comprises (a) installing a production system within the wellbore, wherein the production system includes: a casing pipe extending within the wellbore from the surface; a liquid tubing string extending within the casing; a first production tubing string extending into the casing adjacent the liquid tubing string; and an annulus extending between the liquid tubing string, the first production tubing string, and the casing. In addition, the method comprises (b) producing gas from a production zone in the subterranean formation through the annulus at a first velocity that is greater than a critical velocity. Further, the method comprises (c) pumping liquid through a liquid tubing string after (b) to reduce a level of the liquid. Still further, the method comprises: (d) shutting in the annulus after (b) after the first velocity decreases below the critical velocity, wherein the annulus has a first cross-sectional area and the first production string has a second cross-sectional area that is less than the first cross-sectional area; and (e) producing gas from the production zone through the first production tubing string after (d) at a second velocity that is greater than the critical velocity.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
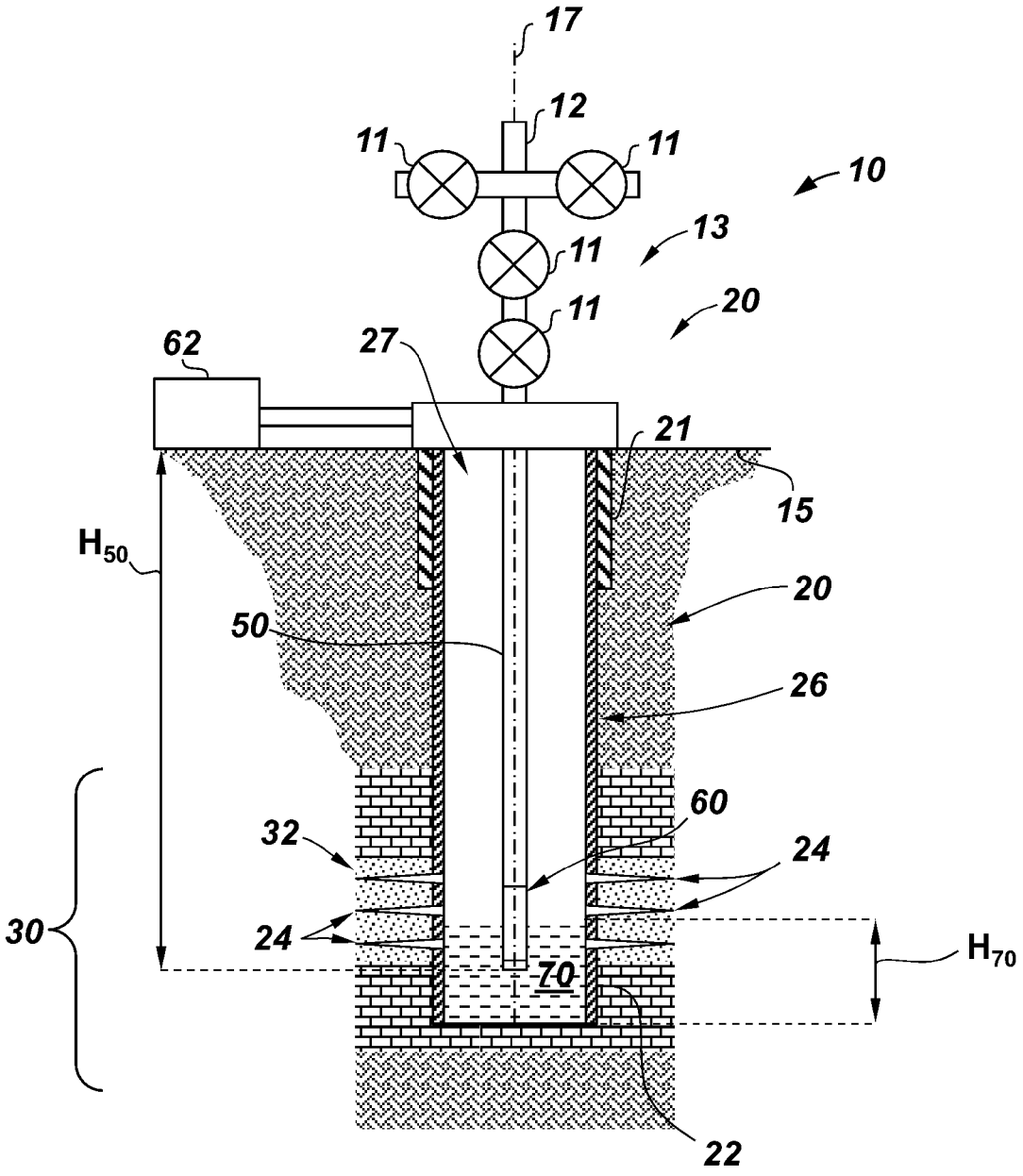
FIG. 1 is a schematic, side, partial cross-sectional view of a conventional production system for subterranean well producing gas hydrocarbons.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

As used herein, the term "critical velocity" refers to the minimum velocity of a gas or other fluid required to carry a droplet of liquid (e.g., water) to the surface (e.g., surface 15) from a subterranean well. In general, the critical velocity can be calculated and/or determined by techniques known in the art that consider a multitude of factors including, without limitation, the liquid and gas phase densities of produced fluids, the surface tension of produced fluids, the pressure of the produced fluid as it traverses from the formation (e.g., formation 30) to surface, the viscosity of the produced fluid, and the temperature of the produced fluid. Without being limited by this or any particular theory, the actual velocity of produced gas to the surface is a function of the inner wellbore pressure at formation depth (specifically the difference between the pressure at formation depth and the surface pressure), the cross-sectional area/diameter of the flow path through which the produced gas flows, and the drag coefficient of the material making up the flow path. In particular, for gases flowing to the surface, the actual velocity of the produced gas is directly related to the inner wellbore pressure at the formation depth in the production zone of interest (i.e., the greater the inner wellbore pressure relative to the surface pressure, the greater the velocity of the produced gas to the surface, and vice versa); and also inversely related to the cross-sectional area/diameter of the flow path through which the produced gas flows (i.e., the smaller the cross-sectional area/diameter of the flow path, the greater the velocity of the produced gas, and vice versa). However, it should be appreciated that the flow of gas to the surface (e.g., surface 15) is also affected by the relative pressures in the wellbore at the formation depth and within the formation itself. Specifically, the velocity of gas flowing into the wellbore is inversely related to the wellbore pressure at the formation depth, such that the velocity of gas flowing into the wellbore from the formation increases as the wellbore pressure at formation depth decreases relative to the formation pressure. In addition, for flow from the wellbore to the surface, if the cross-sectional area of the flow path is sufficiently small, then the friction between the inner surface of the flow path and the fluid flowing therethrough results in an overall decrease in the velocity of the fluid.

A related value to the critical velocity is the "critical rate" which, as used herein, refers to the minimum volumetric or mass flow rate of a gas or other fluid required to carry a droplet of liquid (e.g., water) to the surface (e.g., surface 15) from a subterranean well through a specific flow path having a known cross-sectional area. These two values are related in that the critical rate corresponds to flow at the critical velocity within a specific flow path.

Referring again to FIG. 1, as previously described, as well 20 matures the reservoir pressure and volumetric flow rate of gas entering wellbore 26 from production zone 32 decreases. Once the gas velocity dips below the critical velocity, liquids begin to accumulate at the bottom of the wellbore 26 and exert a back-pressure on production zone 32. To maintain and continue production from well 20, operators typically deliquify the well 20 by pumping (e.g., with pump 60) accumulated liquids to the surface 15 through liquid tubing string 50. Such processes often require long periods of operation for pump 60 and surface mechanism 62, which increases the wear and damage incurred thereby, and thus eventually necessitates a halt in production in order to repair or replace such equipment. These halts in production increase the overall cost to produce well 20. However, as will be described in more detail below, embodiments disclosed herein provide for the installation and utilization of a separate production tubing string (or plurality of production tubing strings) to enable gas to be produced at a sufficient velocity in order to raise at least a portion of the liquid droplets produced from the formation up to the surface, thereby reducing the necessary running time for pump 60 and reducing the number of failures experienced by such equipment.

Figure 2:
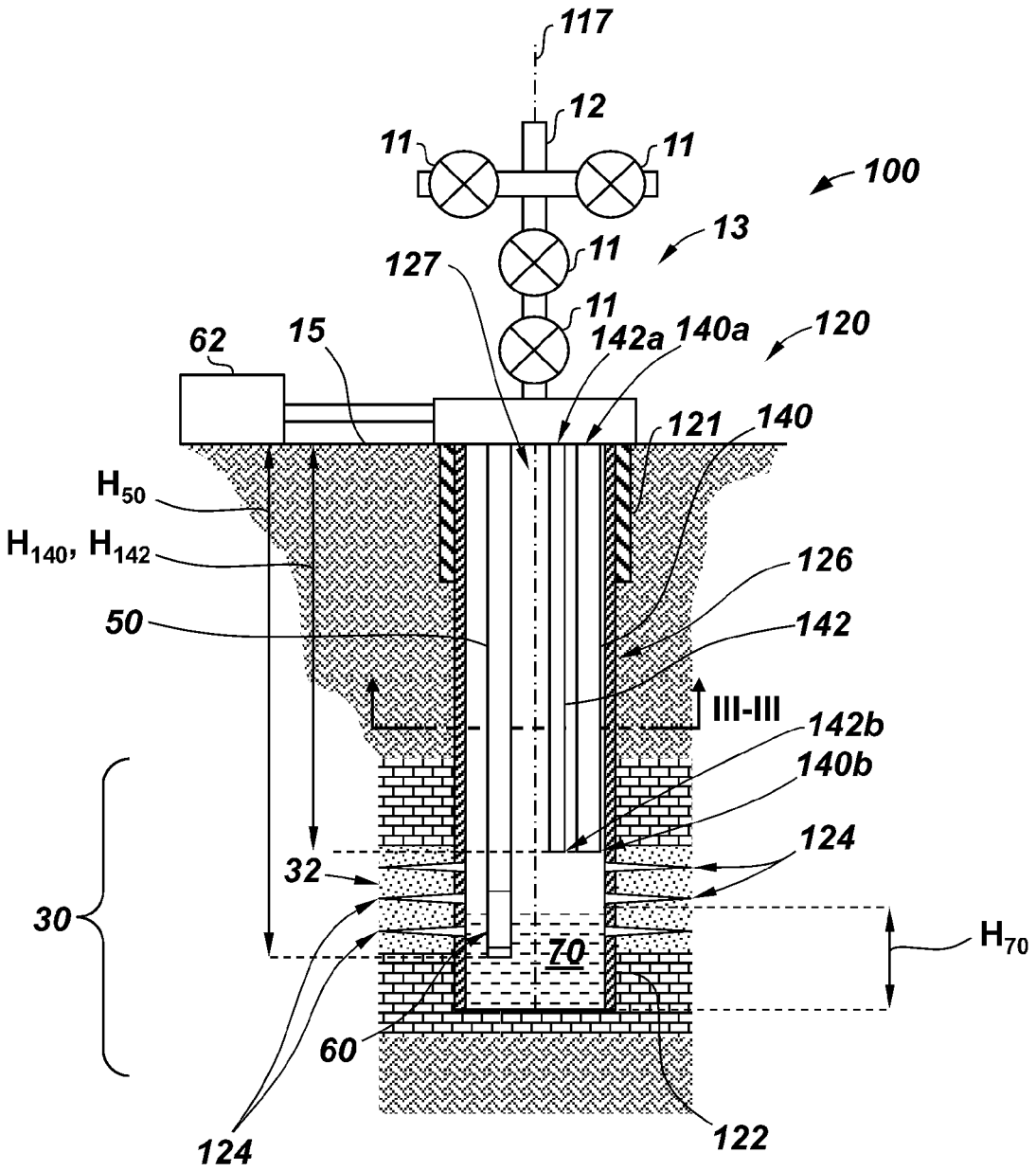
FIGS. 2 is a schematic, side, partial cross-sectional view of an embodiment of a system in accordance with the principles disclosed herein for producing hydrocarbon gases from a subterranean wellbore.
Figure 3:
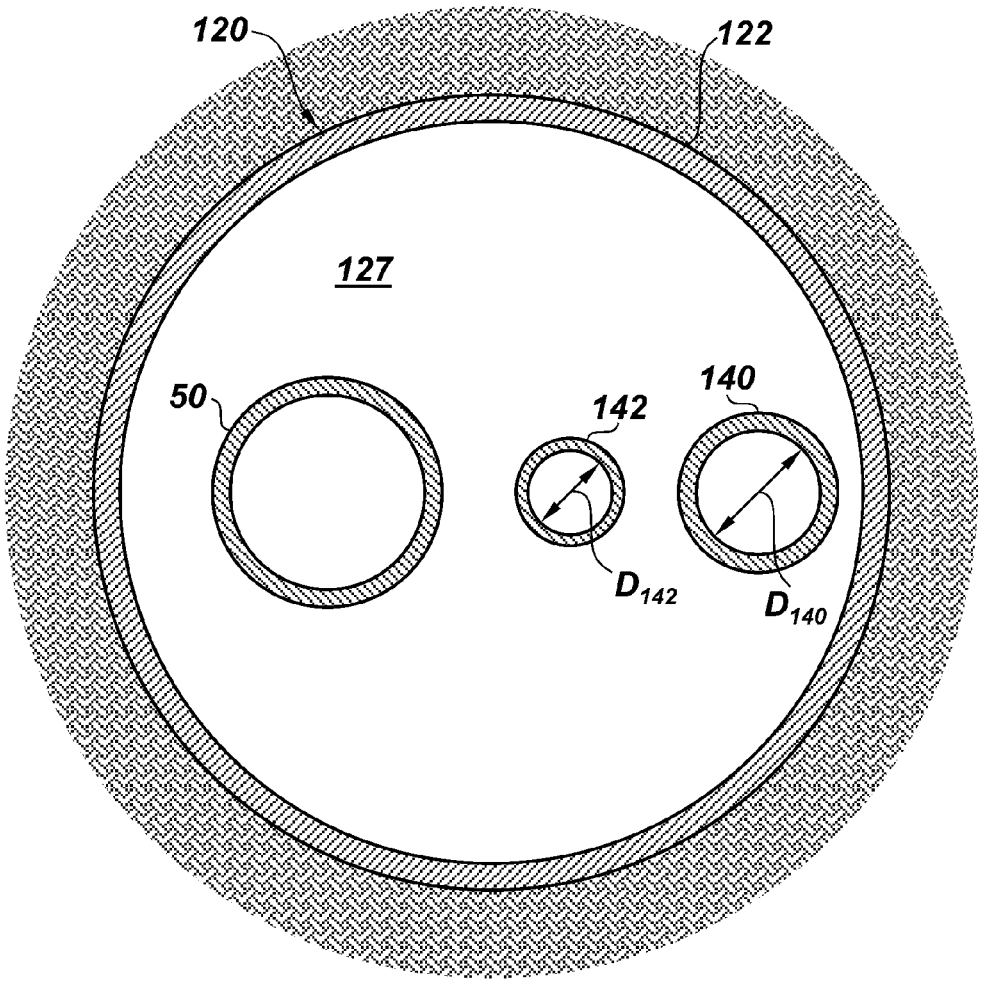
FIG. 3 is a schematic cross-sectional view of the system of FIG. 2 taken along section in FIG. 2.

Referring now to FIGS. 2 and 3, an embodiment of a production system 100 for producing hydrocarbon gas from a well 120 is shown. Well 120 includes a wellbore 126 that extends into subterranean formation 30 along a longitudinal axis 117. In this embodiment, formation 30 includes a production zone 32 as previously described. System 100 includes a wellhead 13 disposed at the upper end of wellbore 126, a production tree 12 mounted to wellhead 13 at the surface 15, a primary conductor 121 extending from wellhead 13 into wellbore 126, and a casing 122 extending from wellhead 13 through conductor 121 and wellbore 126. A set of perforations 124 extend radially through casing 122 into production zone 32, thereby providing a path for fluids in zone 32 to flow through casing 122 into wellbore 126. In addition, system 100 includes liquid tubing string 50, previously described, which extends into casing 122 and thereby at least partially defines an annulus 127 extending radially between string 50 and casing 122.

System 100 further includes a first elongate production tubing string 140 and a second elongate production tubing string 142 each extending within annulus 127 of casing 122 into wellbore 126. In particular, string 140 has a first or upper end 140*a*, and a second or lower end 140*b* opposite the upper end 140*a*. String 142 is adjacent string 140 within annulus 127 and includes a first or upper end 142*a*, and a second or lower end 142*b* opposite the upper end 142*a*. In this embodiment, upper ends 140*a*, 142*a* of each string 140, 142, respectively, are coupled to wellhead 13 and lower ends 140*b*, 142*b* of each string 140, 142, respectively, extend through casing 122 to a depth $H_{140}$, $H_{142}$, respectively. In addition, in this embodiment depth $H_{140}$, is substantially the same as depth $H_{142}$ and each depth $H_{140}$, $H_{142}$ is chosen such that the lower ends 140*b*, 142*b* are proximate perforations 124 and are shallower than depth $H_{50}$ of string 50. Thus, strings 140, 142 are positioned to produce gas from production zone 32. Valves 11 on tree 12 are configured to allow the independent and selective control of the flow of fluids through each string 140, 142, 50. Specifically, valves 11 can be independently and selectively actuated to restrict the flow of fluids through any one or more of strings 140, 142, and/or 50.

Referring now to FIG. 3, each production tubing string 140, 142 has an inner diameter $D_{140}$, $D_{142}$, respectively, that defines the cross-sectional area of the path for produced hydrocarbon gases flowing therethrough. In this embodiment, the diameter $D_{140}$, of string 140 is larger than the diameter $D_{142}$, of string 142. In addition, in this embodiment, annulus 127 has a cross-sectional area greater than the combined cross-sectional area of the flow paths of strings 140, 142; however, in other embodiments annulus 127 does not have a cross-sectional area greater than the combined cross-sectional area of the flow paths of strings 140, 142 while still complying with the principles disclosed herein. As will be explained in more detail below, in this embodiment, the diameter $D_{140}$, $D_{142}$, of each string 140, 142, respectively, is selected to produce hydrocarbon gas to the surface 15 to prolong the periods of time that pump 60 is switched off or disengaged. Further, those in the art will recognize that tubing strings employed may be tapered, i.e., the inner diameter of tubing string 140 at upper end 140*a* is larger than the inner diameter of the tubing string at lower end 140*b*, so that the tubing string has a weighted average inner diameter across its length. For such tapered tubing strings, the tapered tubing string may have a larger effective diameter (and larger cross-sectional area) relative to another tubing string that has a smaller weight averaged inner diameter and still comply with the principles disclosed herein.

Figure 4:
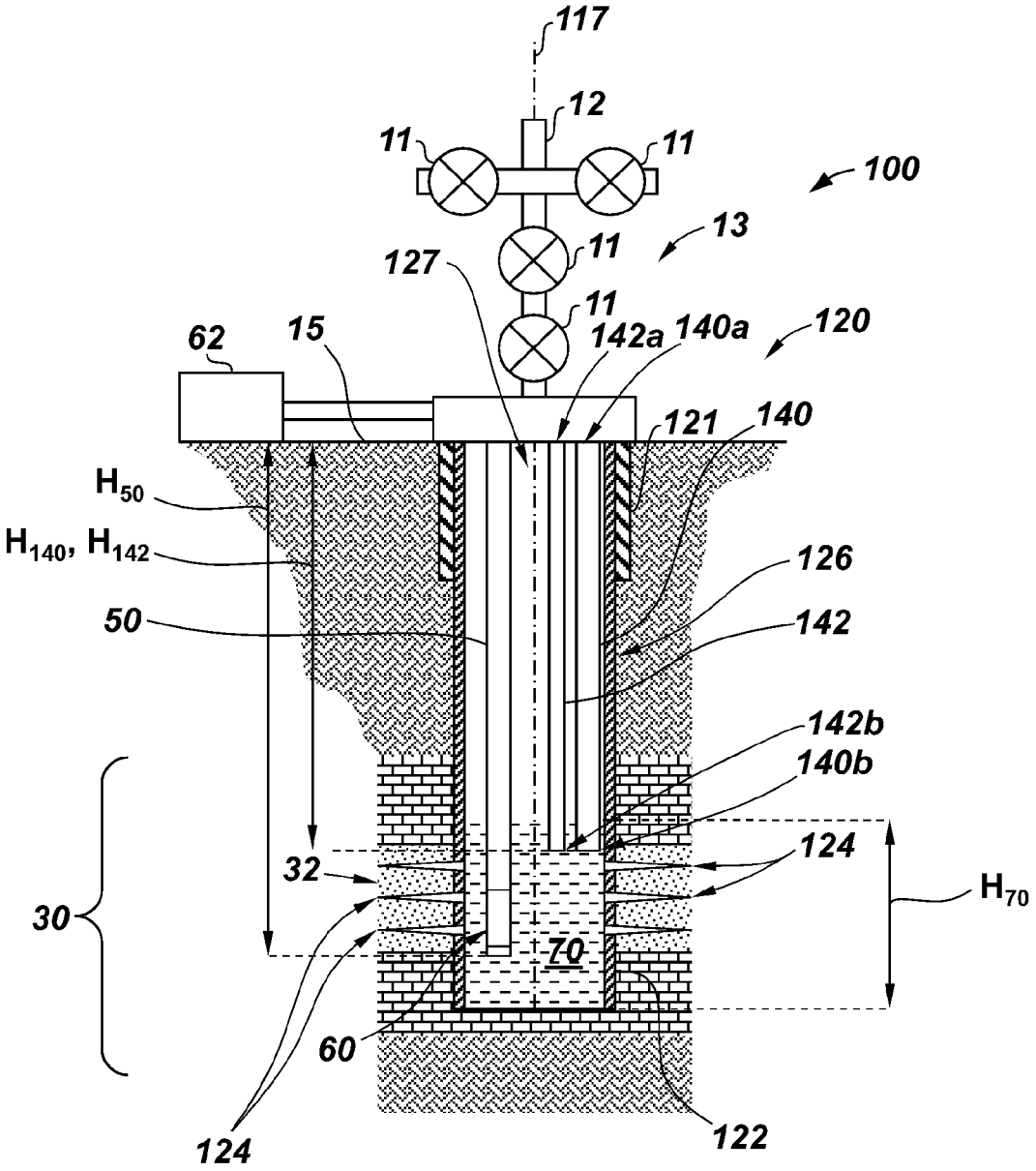
FIG. 4 is a schematic, partial cross-sectional view of the production system of FIG. 2 showing an increased amount of accumulated liquids at the bottom of the wellbore.
Figure 5:
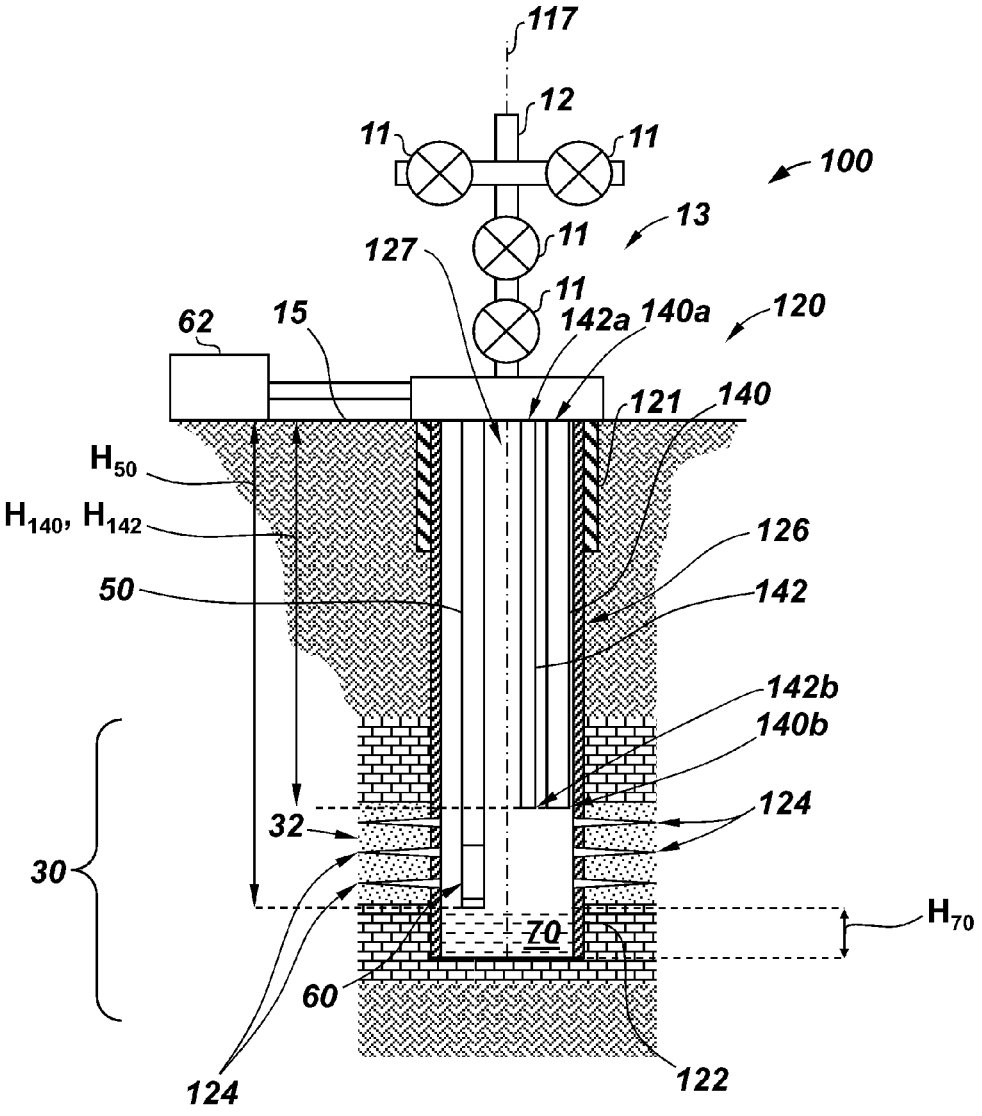
FIG. 5 is a schematic, partial cross-sectional view of the production system of FIG. 2 showing a reduced or decreased amount of accumulated liquids at the bottom of the wellbore.

Referring now to FIGS. 4 and 5, during production operations, hydrocarbon gases and other formation fluids (e.g., oil, water, condensate, etc.) flow into casing 122 from production zone 32 of formation 30 through perforations 124. During the early stages of production, the pressure within and volumetric flow rate from zone 32 is sufficiently high to produce gases to tree 12 above the critical velocity (e.g., through annulus 127) such that any liquids from zone 32 are produced to the surface 15 along with the gas. However, as will be described in more detail below, as well 120 matures, the pressure within and volumetric flow rate from zone 32 generally decrease, resulting in a decrease in the velocity of the produced gases and an accumulation of liquids (e.g., column 70) (see FIG. 4). In order to maintain and/or reduce the level $H_{70}$ of liquids within wellbore 126 (e.g., height $H_{70}$) pump 60 and surface mechanism 62 are engaged to draw out liquids from wellbore 126 through string 50 (see FIG. 5). In addition, in embodiments disclosed herein, operators can manipulate the valves 11 on tree 12 to provide alternate flow path(s) for produced gases to ensure production above the critical velocity to lift at least a portion of the produced liquids to the surface 15 and thus reduce (or eliminate) the necessary running time for pump 60 and mechanism 62.

Figure 6:
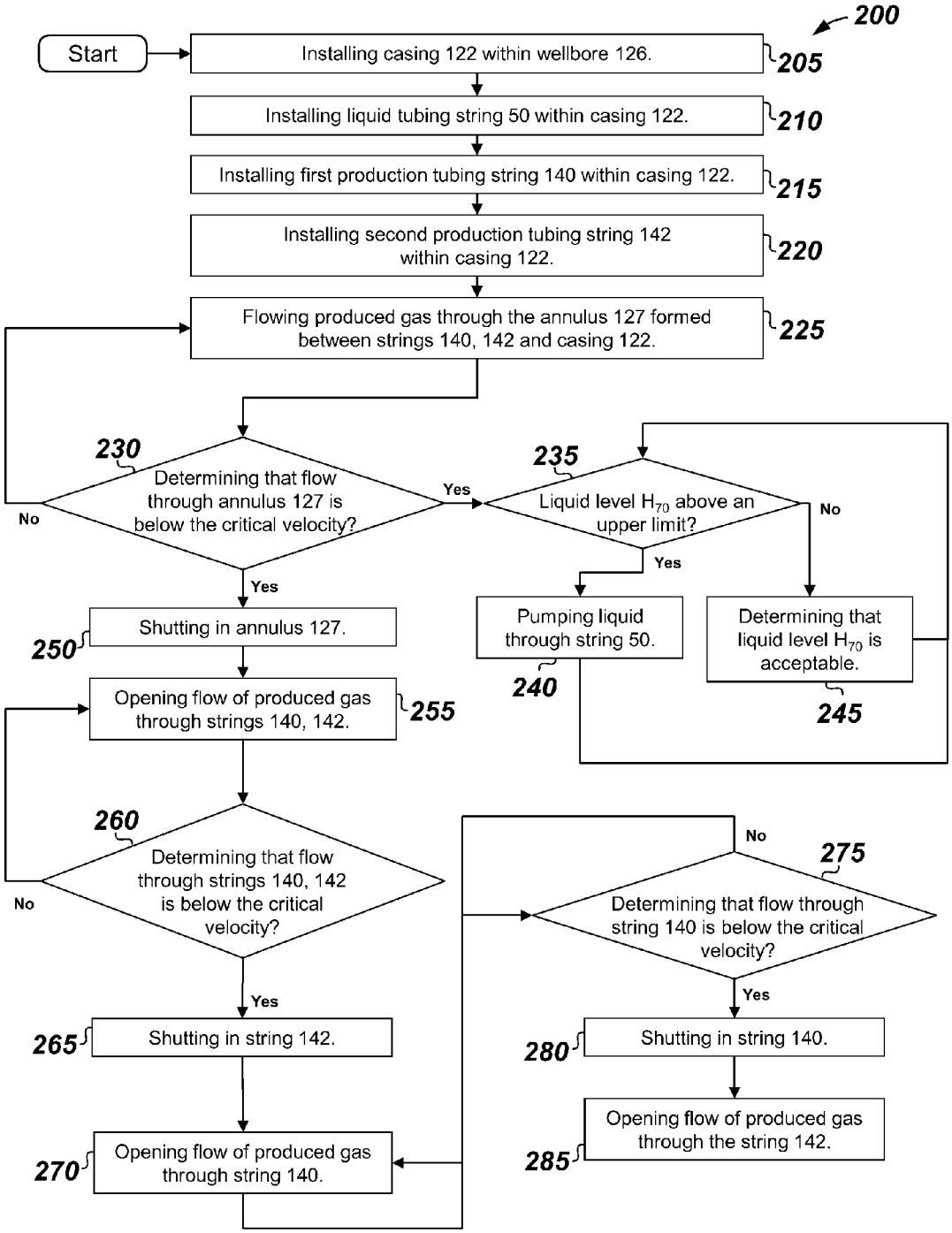
FIG. 6 is a flow chart illustration of an embodiment of a method in accordance with the principles disclosed herein for producing hydrocarbon gases with the system of FIG. 2.

Referring now to FIG. 6, an embodiment of a method 200 of producing hydrocarbon gas from production zone 32 of well 120 is shown. In describing method 200, reference will be made to system 100 shown in FIGS. 2-5 in an effort to provide clarity. In addition, in order to further enhance the explanation of method 200, reference will be made to FIG. 7 wherein a schematic production plan graph or chart 300 for production zone 32 of formation 30 is shown. In chart 300, the vertical or Y-axis 302 of chart 300 represents the production rate from production zone 32 of well 120 in thousands of cubic feet per day ("MCF/D"), while the horizontal or X-axis 304 represents time, which may be measured in hours, days, weeks, months, years, etc.

Referring specifically to FIG. 6, initially the method 200 begins by installing casing 122 within wellbore 126 in block 205, installing the liquid tubing string 50 within casing 122 in block 210, installing the first production tubing string 140 within casing 122 in block 215, and installing the second production tubing string 142 within casing 122 in block 220. As previously described and shown in FIG. 3, string 140 has a larger diameter $D_{144}$ and cross-sectional area than the second production tubing string 142. Further, in this embodiment, the annulus 127 formed between the production tubing strings 140, 142, liquid tubing string 50, and the casing 122 has a cross-sectional area greater than the combined cross-sectional area of the production tubing strings 140, 142. Still further, as previously described, lower ends 140*b*, 142*b* of the production tubing strings 140, 142, respectively, are positioned to produce from production zone 32 of formation 30.

Figure 7:
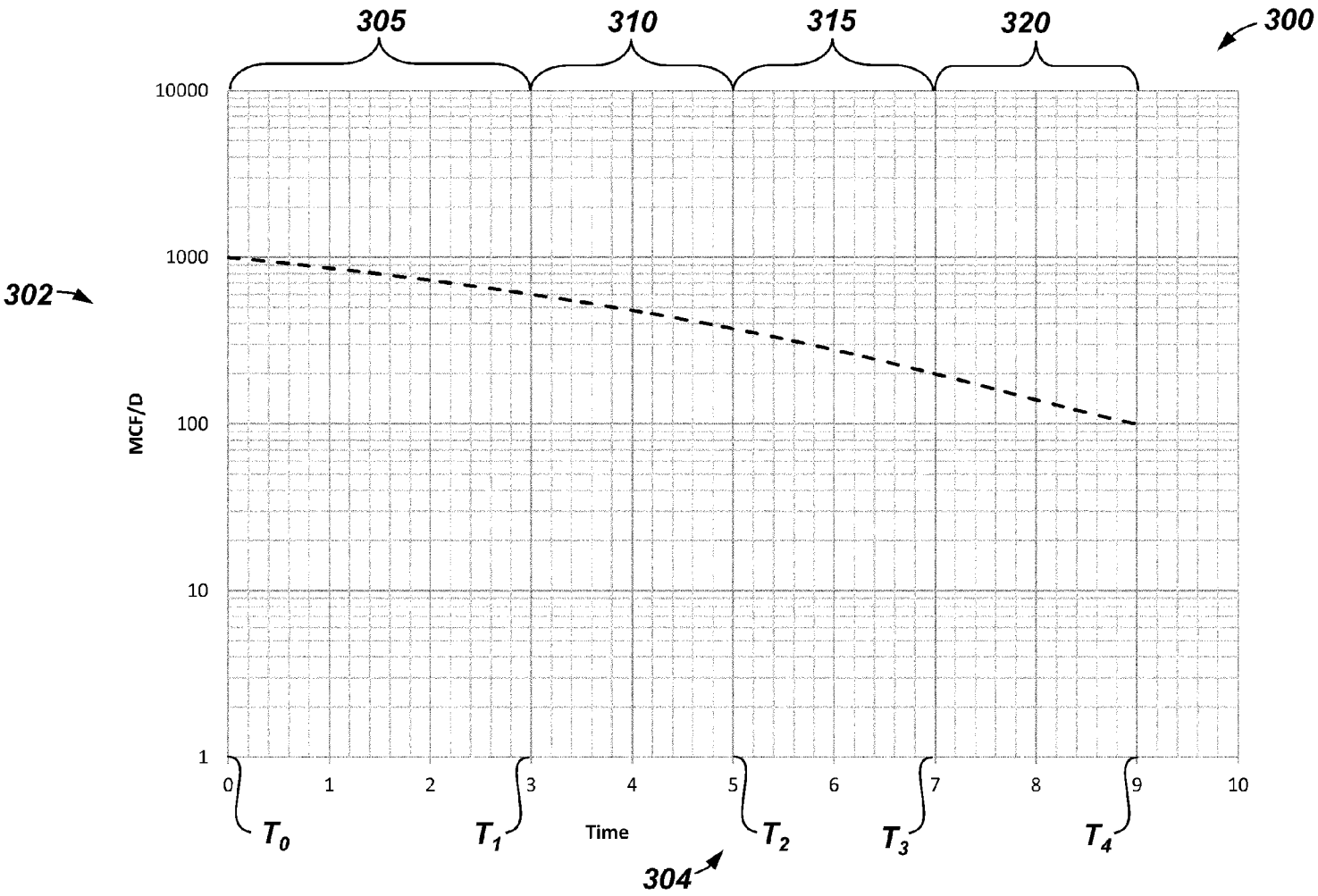
FIG. 7 is a graphical illustration of the gas production versus time for the system of FIG. 2.

Referring still to FIG. 6, the method 200 next includes producing or flowing gases from production zone 32 through annulus 127 at block 225. As shown in FIG. 7, throughout the production life of well 120, the pressure within the formation 30 drops relative to the pressure within wellbore 126, thereby resulting in a continuous drop in the volumetric flow rate from production zone 32. Thus, production through annulus 127 at block 225 results in a first period of production 305 from zone 32 (i.e., from time $T_0$ to time $T_1$) wherein the pressure within and the flow rate from production zone 32 are relatively high, thereby allowing fluids produced from the production zone 32 to be routed or flowed up annulus 127 at a velocity greater than the critical velocity. Production in period 305 through annulus 127 continues until time $T_1$, when the pressure within and flow rate from production zone 32 have sufficiently decreased such that the produced gas flowing through annulus 127 has a velocity below the critical velocity. In order to raise the velocity of the produced gas back above the critical velocity, it becomes necessary to transition the gas production from annulus 127 to a smaller flow path.

Therefore, referring back now to FIG. 6, a first determination 230 is made as to whether the velocity of gas produced through annulus 127 is less than the critical velocity. If "no" then produced gas continues to be flowed up annulus 127 in block 225. If "yes" then production is transitioned from the annulus 127 to the first and second production tubing strings 140, 142, respectively, by shutting in annulus 127 at block 250 and opening both the first and second production strings 140, 142, respectively, at block 255 to flow produced gases up the strings 142, 144 simultaneously. Although the transition of producing through the annulus 127 to producing through strings 140, 142 does not increase the total production rate, the smaller cross-sectional area of the strings 140, 142 (as compared to annulus 127) results in an increase in the actual total velocity of the produced gas above the critical velocity. In some embodiments, shutting in annulus 127 and opening flow through both strings 140, 142 is accomplished through manipulation of valves 11 on tree 12, previously described. As shown in FIG. 7, transitioning the flow from annulus 127 to strings 140, 142 in blocks 250, 255 marks the end of the first period of production 305 and the beginning of a second period of production 310 from production zone 32 (i.e., from time $T_1$ to time $T_2$).

In addition, if the determination in block 230 is "yes" a second determination 235 is made as to whether the liquid level (e.g., height $H_{70}$ of column 70) is above a predetermined upper limit In some embodiments, the upper limit corresponds to a height $H_{70}$ of column 70 within the wellbore 126 which begins to significantly affect the rate of gas production from the well 120 in the manner previously described above. If "no" then a determination is made in box 245 that the liquid level is acceptable. Thereafter, the method 200 reinitiates the determination in block 235 to reassess the level $H_{70}$ of liquids within wellbore 126. If, on the other hand, the determination in block 235 is "yes", then liquids are produced or pumped through the liquid tubing string 50 in block 240 to reduce the liquid level $H_{70}$. In some embodiments, liquid is pumped through string 50 with the aid of pump 60 and mechanism 62. Thereafter, the method 200 reinitiates the determination in block 235 to reassess the level $H_{70}$ of liquids within wellbore 126. Thus, in this embodiment, once the determination is made in block 230 that produced gases are flowing through annulus 127 below the critical velocity, a continuous determination loop is triggered which results in intermittent pumping of liquids through string 50 to maintain the level of liquid $H_{70}$ within the wellbore 126 below a predetermined upper limit. As a result, intermittent pumping of fluids through string 50 continues throughout method 200 once the determination is made in block 230 that produced gases are flowing through the annulus 127 below the critical velocity. It should be appreciated that in some embodiments, the determination in block 235 may be initially triggered at any point during method 200, such as, for example, after the determination in block 260 and/or the determination in block 275 while still complying with the principles disclosed herein.

As previously described, if the determination in block 230 is "yes", then production is transitioned from the annulus 127 to the first and second production tubing strings 140, 142, respectively, by shutting in annulus 127 at block 250 and opening both the first and second production strings 140, 142, respectively, at block 255 to flow produced gases up the strings 142, 144 simultaneously. Referring again to FIG. 7, as with the first production period 305, production in period 310 through strings 140, 142 continues until time $T_2$, when the pressure within and flow rate from production zone 32 has sufficiently decreased such that the produced gas flowing through strings 140, 142 has a velocity below the critical velocity. In some embodiments, this determination is made by analyzing the velocity and/or flow rate of the produced gas flowing through string 140, as flow through string 140 will, in at least some circumstances, tend to have a slower velocity due to its relatively larger diameter $D_{140}$ and thus cross-sectional areas as compared to string 142. In an effort to increase the velocity of the produced gas back above the critical velocity (to ensure adequate lifting of liquid droplets) it once again becomes necessary to transition from flow through strings 140, 142 simultaneously to a smaller flow path.

Thus, referring back now to FIG. 6, during production in block 255, a third determination 260 is made as to whether the velocity of gas produced through the first and second tubing production strings 140, 142 respectively, is less than the critical velocity. If "no" then produced gas continues to be flowed up strings 140, 142 in block 255. If "yes" then production is transitioned from strings 140, 142 to the first production tubing string 140 by shutting in the second production tubing string 142 at block 265 (e.g., through manipulation of valves 11 on tree 12) and opening flow of produced gas through the first production tubing string 140 in block 270 to flow produced gas through string 140. Again, while the transition of producing through strings 140, 142 to producing through string 140 does not increase the total production rate, the smaller cross-sectional area of string 140 results in an increase in the actual total velocity of the produced gas above the critical velocity. Referring again to FIG. 7, transitioning from simultaneous flow through each of the strings 140, 142 to flow through only the string 140 marks the end of the second period of production 310 and the beginning of the third period of production 315 (i.e., from time $T_2$ to time $T_3$). As noted above for both the first and second periods of production 305, 310, respectively, production in period 315 through string 140 continues until time $T_3$, when the pressure within and flow rate from production zone 32 has sufficiently decreased such that the produced gas flowing through string 140 has a velocity below the critical velocity, thereby again resulting in the need to transition from flow through string 140 to a smaller flow path.

As a result, referring back now to FIG. 6, during production in block 270, a fourth determination 275 is made as to whether the velocity of gas produced through the first production tubing string 140 is less than the critical velocity. If "no" then produced gas continues to be flowed up the first production tubing string 140 in block 270. If "yes" then production is transitioned from the second production tubing string 140 to the first production tubing string 142 by shutting in string 140 at block 280 and opening flow through string 142 in block 285. While the transition of producing through string 140 to producing through string 142 does not increase the total production rate, the smaller cross-sectional area of string 142 results in an increase in the actual total velocity of the produced gas above the critical velocity. As previously described, shutting in string 140 in block 280 and opening flow through string 142 in block 285 is accomplished, in some embodiments, through manipulation of valves 11 on tree 12. In some embodiments, production through string 142 continues until the pressure within and flow rate from zone 32 has sufficiently decreased such that the produced gases flowing through string 142 has a velocity below the critical velocity. Because string 142 represents the smallest flow path available within the embodiment of system 100 shown in FIGS. 2-5, production through string 142 continues until the level of accumulated liquids within wellbore 26 reaches a sufficient level (e.g., $H_{70}$) to effectively choke off production from zone 32. Thereafter, either production from zone 32 is ceased (thus resulting in an ever decreasing line tending to zero after $T_4$ in chart 300 shown in FIG. 7) or pump 60 is run for longer periods of time to ensure continued production from well 120.

Referring still to FIGS. 2-6, in general, the determination of whether the actual velocity of the produced gas is above, at, or below the critical velocity (e.g., blocks 230, 260, 275) can be accomplished using any suitable means known in the art. In particular, in some embodiments, the determinations in blocks 230, 260, 275 are made by directly monitoring the velocity of the gas flowing through the relevant flow path. In other embodiments, the determinations in blocks 230, 260, 275 are made through measurement of other parameters such as, for example, the difference between the shut in pressure within the annulus 127 and the pressure at the surface 15 within the currently utilized flow path (e.g., at upper end 140*a* and/or 142*a*). In one specific example, the actual production rate (e.g., the vertical axis of chart 300) for well 120 at a given time (e.g., $T_1$) can be measured and monitored to estimate whether the actual velocity of the produced gas is above, at, or below the critical velocity. Generally speaking, the measured production rate corresponds with the pressures within the formation 30 and the inner wellbore pressure at perforations 124, and thus, is directly related to the velocity of fluids produced therefrom. In other embodiments, still other known parameters may be used to make the determination of whether the velocity of the produced gas is above or below the critical velocity such as, for example, the pressure within formation 30 (or zone 32), the pressure within wellbore 126 (e.g., the static pressure within the wellbore 126 at or near the surface), the volumetric or mass flow rate of produced gases from zone 32, the liquid content of fluids produced from well 120 (e.g., determining whether slugging is occurring or whether liquids are being produced as a relatively constant mist), the difference between the casing pressure and the flowing tubing pressure (e.g., when casing is shut in), or some combination thereof.

As another example, in some embodiments, the pressure drop per unit length of a given flow path (e.g., annulus 127, string 140, and/or string 142) is measured to determine whether liquids (e.g., water) are accumulating within wellbore 126, thereby influencing the decision to transition to a smaller flow path. For instance, in some embodiments, both the surface pressure (i.e., pressure at the surface 15) of the fluid produced from the well 120, and the static pressure within the wellbore 126 near the entrance of the currently utilized flow path are each measured and/or estimated. A pressure differential is then taken between these two values and then divided by the length of the current flow path, thereby resulting in the average pressure drop per unit length at specific point in time. When this value rises or increases, it serves, at least in some embodiments, as an indication that liquids are accumulating near the entrance of the current flow path. This therefore allows operators to conclude that it is now time to engage the pump 60 and/or transition to a smaller flow path in order to raise the velocity of the gas back above the critical velocity, thereby reestablishing the lifting of liquid droplets to the surface.

In addition, in some embodiments the pressure of formation 30 and/or volumetric flow rate of produced gas over the entire expected producing life of well 120 is estimated prior to engaging in production activities therefrom. Thus, in these embodiments, the relative sizing of strings 140, 142 (e.g., $D_{140}$, $D_{142}$) is chosen to produce flow above the critical velocity for most if not all of the producing life of well 120 based, at least partially, on the predetermined values of the formation pressure and the volumetric flow rate over that lifetime. For example, in some embodiments, the relative sizing of strings 142, 144, 146, 148 is determined by examining information received during completion activities of well 120. In particular, in these embodiments, an examination of the production rate of fluid occurring during completion activities is examined and may even be compared to the production rates of neighboring wells to determine the likely decay of pressure within formation 130 during the producing life of well 120.

Further, while the determinations in blocks 230, 260, 275 have been described in terms of the critical velocity, it should be appreciated that in other embodiments, the determinations in blocks 230, 260, 275 may be carried out with consideration of the critical rate, while still complying with the principles disclosed herein. For example, in some embodiments, the determinations in blocks 230, 260, 275 may inquire as to whether the flow rate (e.g., volumetric of mass) of fluid flowing through a given flow path is below the critical rate (rather than the critical velocity) for that flow path.

Still further, the determination as to the level $H_{70}$ of liquid within wellbore 126 (e.g., in block 235) can be carried out by any suitable technique known in the art. For example, in some embodiments, the level $H_{70}$ of liquid is determined through use of a downhole gauge or through the analysis of reflected acoustic waves (e.g., "shooting"). In addition, in some embodiments, the level $H_{70}$ of liquids is determined through use of software packages that are built into a control system that is used to operate pump 60. In particular, in some embodiments, strain gauges or similar devices are disposed on pump 60 and/or mechanism 62 to measure and/or calculate the efficiency or percentage Pillage of pump 60. These values are then used to calculate a fluid level $H_{70}$. In addition, it should be appreciated that in some embodiments the decision to engage/disengage pump 60 is based on various pressure readings within, for example, annulus 127, string 140, and/or string 142 either in lieu or in addition to the measurement and/or estimation of the level $H_{70}$ of fluid within the wellbore 126.

In the manner described, at least a portion of the liquid produced from a gas well (e.g., well 120) is lifted to the surface (e.g., surface 15) for a larger percentage of the producing life of the well; thereby maintaining an acceptable level (e.g., $H_{70}$) of accumulated liquids within the wellbore (e.g., wellbore 126) while also decreasing the necessary running time for artificial lift mechanisms (e.g., pump 60). This reduced running time for the artificial lift mechanisms further reduces the amount of wear experienced by such systems and thereby decreases the risk of a halt or loss of production due to a failure of such equipment. Therefore, through use of a production system in accordance with the principles disclosed herein, mature and/or marginal wells that produce gas and liquids with the aid of artificial lift equipment may be produced for longer periods for more economically favorable results.

While embodiments disclosed and shown herein have included the use of a pair of production tubing strings 140, 142, it should be appreciated that in other embodiments, more or less than two production tubing strings may be used while still complying with the principles disclosed herein. For example, in some embodiments, only a single production tubing string (e.g., either tubing string 140 or 142) may be installed within the wellbore along with the liquid tubing string in order to produce hydrocarbon gas at or above the critical value during operation. Further, while embodiments disclosed herein have described flowing up successively smaller flow paths (e.g., tubing strings 140, 142) as the pressure within the formation 30 falls over the life of the well 20, it should be appreciated that in other embodiments, multiple tubing strings or flow paths (e.g., string 140, 142, annulus 27) may be flowed simultaneously over the life of well 20 while still complying with the principles disclosed herein. For example, in some embodiments, fluids may be flowed up the annulus 127 and one or both of the strings 140, 142 during the initial stages of production. Thereafter, the flow through one of more of the annulus 127, string 140, or string 142 may be shut off in order to increase the velocity of produced fluids above the critical velocity. As production continues, various other combinations of flow paths may be used to maintain the flow of produced fluids above the critical velocity and thus lift at least a portion of the liquids produced from formation 30 to the surface 15. Still further, while embodiments described herein have included a pair of production tubing strings 140, 142 extending to depths $H_{140}$, $H_{142}$, respectively, that are substantially the same, it should be appreciated that in other embodiments, the depths $H_{140}$, $H_{142}$ of each of the strings 140, 142, respectively may not be substantially the same while still complying with the principles disclosed herein. In addition, while casing 122 has been shown to extend substantially the entire length of wellbore 126, it should be appreciated that in other embodiments, casing 122 may not substantially extend along the entire length of wellbore 126 while still complying with the principles disclosed herein.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for producing gas from a well including a wellbore extending from a surface into a subterranean formation, wherein the well also produces a liquid, the method comprising:

(a) producing gas from a production zone in the subterranean formation through an annulus extending within the wellbore at a first velocity that is greater than a critical velocity;

(b) shutting in the annulus after (a) after the first velocity decreases below the critical velocity, wherein the annulus has a first cross-sectional area and a first production string has a second cross-sectional area that is less than the first cross-sectional area;

(c) producing gas from the production zone through the first production tubing string after (b) at a second velocity that is greater than the critical velocity; and (d) pumping liquid through a liquid tubing string with a pump during (c) to reduce a level of the liquid within the wellbore.

2. The method of claim 1, wherein (d) further comprises: intermittently pumping liquid through the liquid tubing string with the pump during (c).

3. The method of claim 1, further comprising:

(e) producing gas from the production zone through both the first production tubing string and a second production tubing string simultaneously after (b) and before (c) at a third velocity that is greater than the critical velocity; and (f) shutting in the second production tubing string after (e) and before (c) when the third velocity decreases below the critical velocity to transition the production gas from the production zone from both the first production tubing string and the second production tubing string to the first production tubing string.

4. The method of claim 3, further comprising: intermittently pumping liquid through the liquid tubing string with the pump during (e).

5. The method of claim 3, further comprising:

(g) shutting in the first production tubing string and opening the second production tubing string, after (c) after the second velocity decreases below the critical velocity, to transition the production of gas from the production zone from the first production tubing string to the second production tubing string, wherein the second production tubing string has a third cross-sectional area that is less than the second cross-sectional area of the first production tubing string; and (h) producing gas from the production zone through the second production tubing string after (g) at a fourth velocity that is greater than the critical velocity.

6. The method of claim 5, further comprising: intermittently pumping liquid through the liquid tubing string with the pump during (h).

7. The method of claim 5, wherein the fourth velocity is greater than the second velocity when the production of gas from the production zone is transitioned form the first production tubing string to the second production tubing string in (h).

8. The method of claim 3, further comprising:

(e) installing the first production tubing string within a casing extending into the wellbore before (a);

(f) installing the second production tubing string within the casing before (a); and (g) installing the liquid tubing string within the casing.

9. The method of claim 3, wherein the third velocity is greater than the first velocity when the production of gas from the production zone is transition to both the first production tubing string and the second production tubing string in (e).

10. The method of claim 1, further comprising: determining that the level of the liquids within the wellbore is above a predetermined upper limit before (d).

11. The method of claim 1, wherein the second velocity is greater than the first velocity when the production of gas from the production zone is transitioned to the first production tubing string in (c).

12. A method for producing gas from a well including a wellbore extending from a surface into a subterranean formation, wherein the well also produces a liquid, the method comprising:

(a) installing a production system within the wellbore, wherein the production system includes:

a casing pipe extending within the wellbore from the surface;

a liquid tubing string extending within the casing;

a pump coupled to the liquid tubing string;

a first production tubing string extending into the casing adjacent the liquid tubing string; and an annulus extending between the liquid tubing string, the first production tubing string, and the casing;

(b) producing gas from a production zone in the subterranean formation through the annulus at a first velocity that is greater than a critical velocity;

(c) shutting in the annulus after (b) after the first velocity decreases below the critical velocity, wherein the annulus has a first cross-sectional area and the first production string has a second cross-sectional area that is less than the first cross-sectional area;

(d) producing gas from the production zone through the first production tubing string after (c) at a second velocity that is greater than the critical velocity; and (e) pumping liquid through the liquid tubing string with the pump during (d) to reduce a level of the liquid.

13. The method of claim 12, wherein (e) further comprises: intermittently pumping liquid through the liquid tubing string with the pump during (d).

14. The method of claim 12, further comprising:

(f) installing a second production tubing string within the casing adjacent both the first production tubing string and the liquid tubing string during (a);

(g) producing gas from the production zone through both the first production tubing string and the second production tubing string simultaneously after (c) and before (d) at a third velocity that is greater than the critical velocity; and (h) shutting in the second production tubing string after (g) and before (d) when the third velocity decreases below the critical velocity to transition the production of gas from the production zone from both the first production tubing string and the second production tubing string to the first production tubing string.

15. The method of claim 14, further comprising: intermittently pumping liquid through the liquid tubing string with the pump during (g).

16. The method of claim 14, further comprising:

(g) shutting in the first production tubing string and opening the second production tubing string after (d) after the second velocity decreases below the critical velocity to transition the production of gas from the production zone from the first production tubing string to the second production tubing string, wherein the second production tubing string has a third cross-sectional area that is less than the second cross-sectional area of the first production tubing string; and (h) producing gas from the production zone through the second production tubing string after (g) at a fourth velocity that is greater than the critical velocity.

17. The method of claim 16, wherein the fourth velocity is greater than the second velocity when the production of gas from the production zone is transitioned form the first production tubing string to the second production tubing string in (h).

18. The method of claim 16, further comprising: intermittently pumping liquid through the liquid tubing string with the pump during (h).

19. The method of claim 14, wherein the third velocity is greater than the first velocity when the production of gas from the production zone is transitioned to both the first production tubing string and the second production tubing string in (g).

20. The method of claim 12, further comprising: determining that the level of the liquids within the wellbore is above a predetermined upper limit before (e).

21. The method of claim 12, wherein the second velocity is greater than the first velocity when the production of gas from the production zone is transitioned to the first production tubing string in (d).

* * * * *